US011833828B2

(12) United States Patent
Yoshino et al.

(10) Patent No.: US 11,833,828 B2
(45) Date of Patent: Dec. 5, 2023

(54) LIQUID DISCHARGE HEAD

(71) Applicant: BROTHER KOGYO KABUSHIKI KAISHA, Nagoya (JP)

(72) Inventors: Takaaki Yoshino, Nagoya (JP); Toru Kakiuchi, Chita (JP); Jiro Yamamoto, Nagoya (JP); Taisuke Mizuno, Yokkaichi (JP); Shotaro Kanzaki, Handa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 65 days.

(21) Appl. No.: 17/499,628

(22) Filed: Oct. 12, 2021

(65) Prior Publication Data

US 2022/0126588 A1 Apr. 28, 2022

(30) Foreign Application Priority Data

Oct. 27, 2020 (JP) ..... 2020-179933

(51) Int. Cl.
*B41J 2/175* (2006.01)
*B41J 2/14* (2006.01)

(52) U.S. Cl.
CPC ..... *B41J 2/175* (2013.01); *B41J 2/14201* (2013.01); *B41J 2002/14419* (2013.01); *B41J 2002/14467* (2013.01); *B41J 2002/14491* (2013.01)

(58) Field of Classification Search
CPC ..... B41J 2/175; B41J 2/14201; B41J 2002/14419; B41J 2002/14467;
(Continued)

(56) References Cited

U.S. PATENT DOCUMENTS

2015/0306875 A1* 10/2015 Nishimura ..... B41J 2/14233 347/71
2020/0207100 A1 7/2020 Sugiura et al.
2021/0008882 A1 1/2021 Takabe

FOREIGN PATENT DOCUMENTS

JP 2009-56766 A 3/2009
JP 2019-155905 A 9/2019
(Continued)

OTHER PUBLICATIONS

Takahashi, Tomoaki et al., "Inkjet Recording Head and Image Recording Using the Same", Sep. 16, 2003, Paragraphs 0002, 0033-0066 (Year: 2003).*
(Continued)

*Primary Examiner* — Lisa Solomon
(74) *Attorney, Agent, or Firm* — KENEALY VAIDYA LLP

(57) ABSTRACT

A liquid discharge head includes: nozzles aligned on a nozzle surface; a supply manifold configured that a liquid is supplied therein from the outside of the liquid discharge head; a return manifold which is arranged between the nozzle surface and the supply manifold in a first direction, which is configured that the liquid is flown out therefrom to the outside of the liquid discharge head, and which is provided with a return damper part; and individual flow channels each of which corresponds to one of the nozzles. Each of the individual flow channels has a return throttle channel communicating the corresponding nozzle with the return manifold and being arranged between the return manifold and the nozzle surface in the first direction. The return manifold has a compliance larger than a compliance of the supply manifold.

14 Claims, 5 Drawing Sheets

(58) Field of Classification Search
CPC .... B41J 2002/14491; B41J 2002/14306; B41J 2/14233; B41J 2202/12
See application file for complete search history.

(56) References Cited

FOREIGN PATENT DOCUMENTS

| | | | |
|---|---|---|---|
| JP | 2020-104294 | A | 7/2020 |
| JP | 2020-104295 | A | 7/2020 |

OTHER PUBLICATIONS

IP.com search (Year: 2023).*

* cited by examiner

LIQUID DISCHARGE HEAD

CROSS REFERENCE TO RELATED APPLICATIONS

The present application claims priority from Japanese Patent Application No. 2020-179933, filed on Oct. 27, 2020, the disclosure of which is incorporated herein by reference in its entirety.

BACKGROUND

The present disclosure relates to liquid discharge heads discharging a liquid such as ink or the like.

Conventionally, as one object to restrain an ink in nozzles from bearing high viscosity, there is known such a configuration devised to include a supply manifold and a return manifold to circulate the ink between an ink tank and the liquid discharge head.

As an example, there is known a liquid discharge head where the supply manifold and the return manifold are structured in two layers (two-story structure). By arranging the supply manifold and the return manifold to overlap with each other in planar view, it is possible to facilitate downsizing the head in a planar direction. Further, in the conventional liquid discharge head, because a damper part is provided for each manifold, it is possible to moderate the influence of crosstalk.

SUMMARY

However, in the above liquid discharge head, because the flow channel from the nozzles to the return manifold is shorter than the flow channel from the supply manifold to the nozzles. Therefore, there is a comparatively large influence of crosstalk on the other nozzles through the return manifold. On the other hand, for example, it is possible to suppress the influence of crosstalk to some degree by the presence of the abovementioned damper part, or by provision of a return throttle under the return manifold to secure the length of the return throttle to a certain degree. However, it is not possible to largely suppress the influence of crosstalk through the return manifold. Hence, liquid discharges are liable to be unstable in the abovementioned liquid discharge head.

Accordingly, an object of the present disclosure is to provide a liquid discharge head capable of suppressing the instability of liquid discharges due to crosstalk.

According to an aspect of the present disclosure, there is provided a liquid discharge head including: a plurality of nozzles, a supply manifold, a return manifold, and a plurality of individual flow channels. The plurality of nozzles are aligned on a nozzle surface. The supply manifold is arranged apart from the nozzle surface in a first direction orthogonal to the nozzle surface and is configured that a liquid is supplied therein from the outside of the liquid discharge head. The return manifold is arranged between the nozzle surface and the supply manifold in the first direction, configured that the liquid is flown out therefrom to the outside of the liquid discharge head, and is provided with a return damper part. Each of the plurality of individual flow channels corresponds to one of the plurality of nozzles, and has one end connected to the supply manifold and the other end connected to the return manifold. Each of the plurality of individual flow channels has a return throttle channel communicating the corresponding nozzle with the return manifold and being arranged between the return manifold and the nozzle surface in the first direction. The return manifold has a compliance larger than a compliance of the supply manifold.

DETAILED DESCRIPTION

Hereinbelow, referring to the accompanied drawings, an explanation will be made on a liquid discharge head according to an embodiment of the present disclosure. The liquid discharge head explained below is merely one embodiment of the present disclosure. Therefore, the present disclosure is not limited to the following embodiment, but can undergo addition, deletion, and modification without departing from the true spirit and scope of the present disclosure.

<Configuration of a Liquid Discharge Apparatus>

A liquid discharge apparatus 10 including liquid discharge heads 20 according to this embodiment is configured to discharge a liquid such as an ink or the like. The following explanation will be made with an example of taking the liquid discharge apparatus 10 as an ink jet printer. However, the liquid discharge apparatus 10 is not limited to that in its applications.

Figure 1:
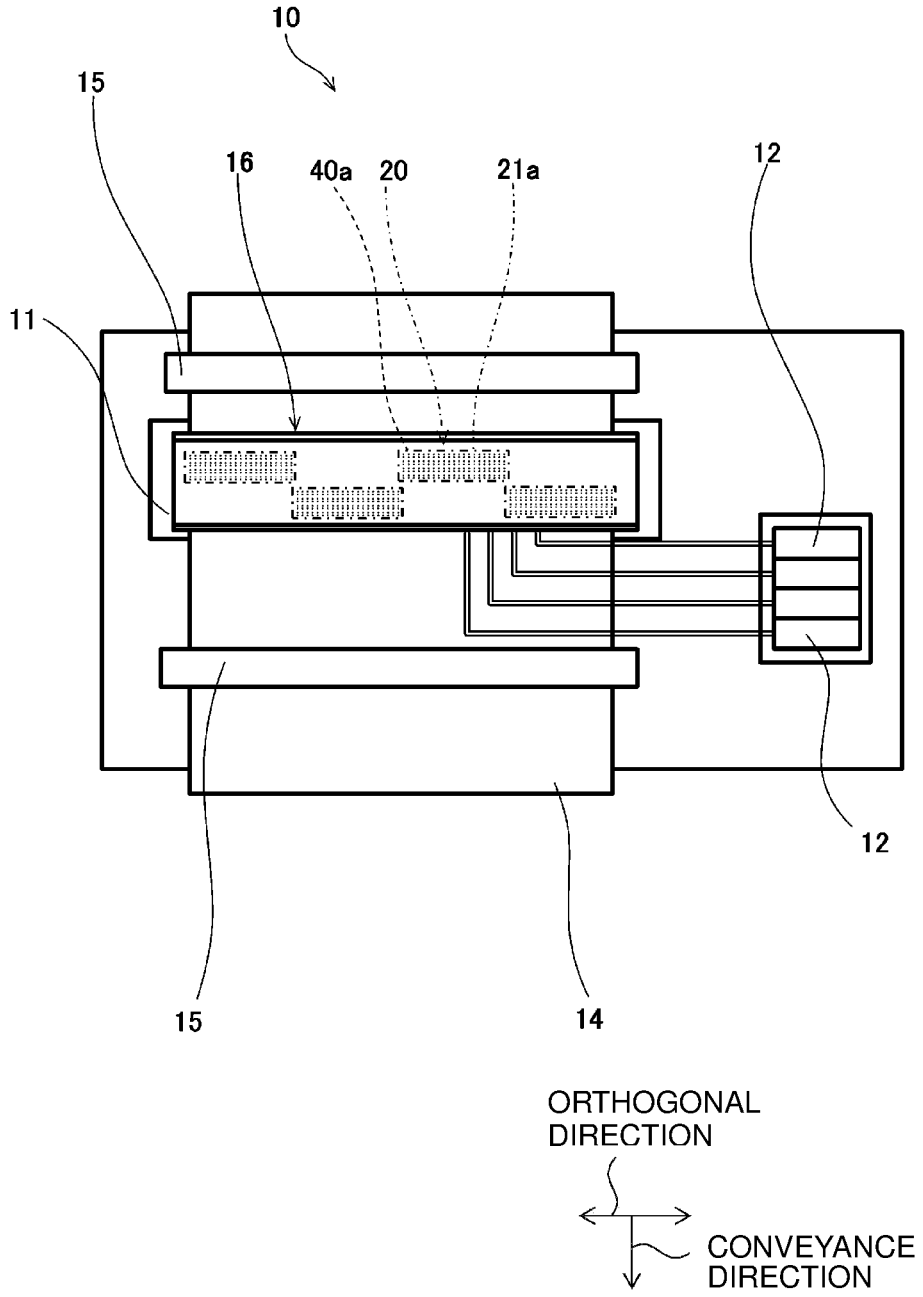
FIG. 1 is a plan view showing a schematic configuration of a liquid discharge apparatus including liquid discharge heads.

As shown in FIG. 1, the liquid discharge apparatus 10 applies a line head method, for example, which includes a platen 11, a conveyer, a head unit 16, and a tank 12. However, the liquid discharge apparatus 10 is not limited to the line head method but, for example, may apply another method such as a serial head method or the like.

The platen 11 is a plate-like member and, on its upper surface, recording paper 14 is placed, the platen 11 playing the role of determining a distance between the recording paper 14 and the head unit 16. Note that the term "upper side" refers to the side near the head unit 16 than the platen 11 in the vertical direction (the first direction) whereas the term "lower side" refers to the opposite side to the former. However, the liquid discharge apparatus 10 is not limited to that arrangement.

The conveyer has, for example, two conveyance rollers 15 and an unshown conveyance motor. The two conveyance rollers 15 are linked to the conveyance motor and arranged to interpose the platen 11 and to be parallel to each other in a direction (an orthogonal direction) orthogonal to a conveyance direction for the recording paper 14. If the conveyance motor is driven, then the conveyance rollers 15 rotate to convey the recording paper 14 on the platen 11 in the conveyance direction. Note that in this embodiment, the orthogonal direction of FIG. 1 is parallel to the extension direction of FIGS. 2 to 5, and the conveyance direction of FIG. 1 is parallel to the width direction of FIGS. 2 to 5.

The head unit 16 is longer than the recording paper 14 in the orthogonal direction. The head unit 16 is provided with the plurality of liquid discharge heads 20.

Each of the liquid discharge heads 20 has a layered body constructed form a flow channel formation body (40 to 54) and a volume change part (55 and 60). The flow channel formation body is formed therein with liquid flow channels where a plurality of nozzle holes 21*a* open in a discharge surface 40*a* (the nozzle surface). The volume change part is driven to change the volume of the liquid flow channels. In this case, in the nozzle holes 21*a*, meniscus vibrates to discharge the liquid. Note that details of the liquid discharge head 20 will be described later on.

In the case of the liquid being an ink, for example, the tank 12 is provided for each type of the ink. For example, four tanks 12 are provided to store therein the inks of black, yellow, cyan, and magenta, respectively. The tanks 12 supply the inks to the corresponding nozzle holes 21*a*.

<Configuration of the Liquid Discharge Head>

Figure 2:
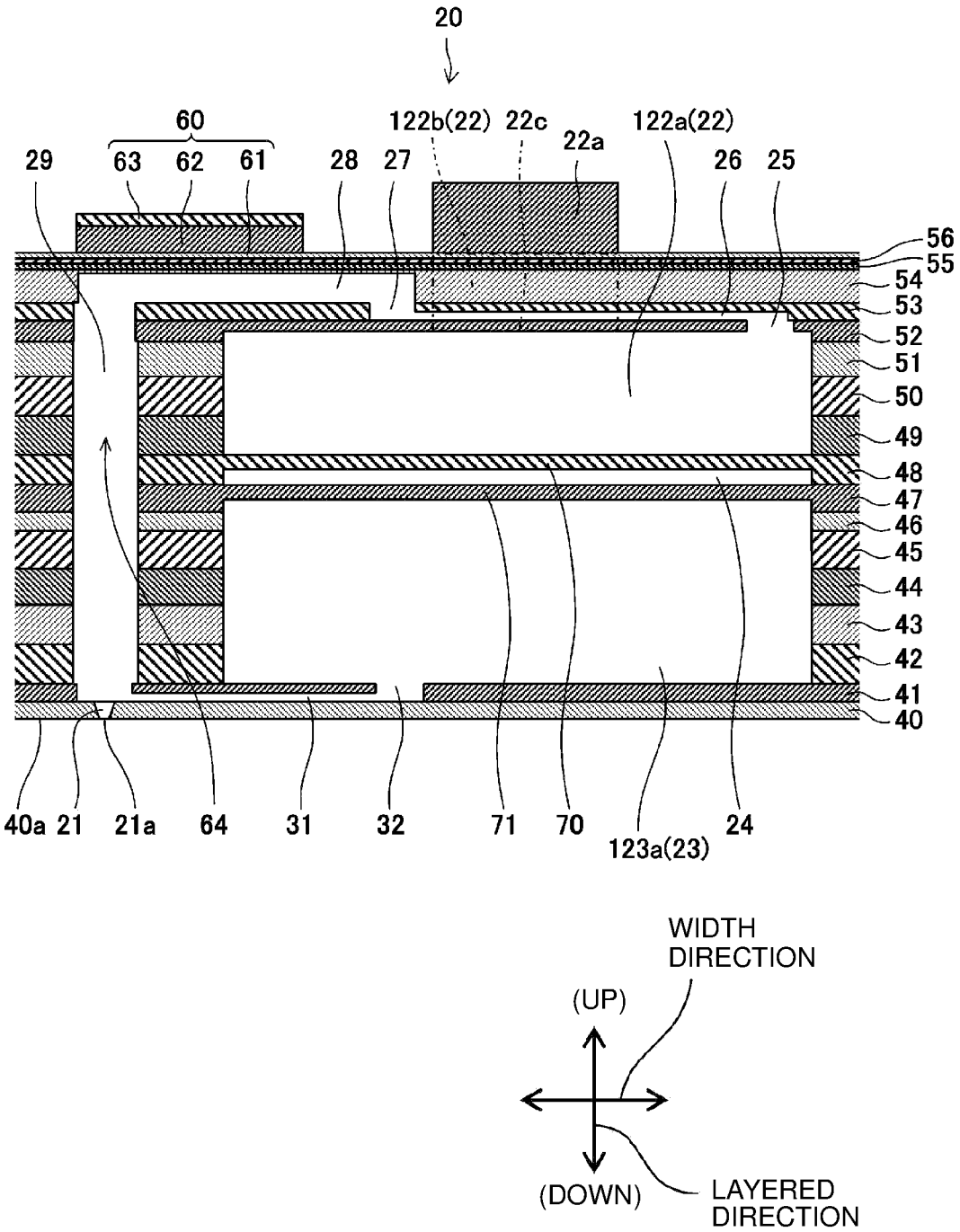
FIG. 2 is a cross section view of one liquid discharge head of FIG. 1, cut through along a line orthogonal to an extension direction.

As described above, the liquid discharge head 20 is provided with the flow channel formation body and the volume change part. As shown in FIG. 2, the flow channel formation body is a layered body of a plurality of plates 40 to 54 (metallic plates, for example), and the volume change part has a vibration plate 55 and a piezoelectric element 60.

The plurality of plates include a nozzle plate 40, a first flow channel plate 41, a second flow channel plate 42, a third flow channel plate 43, a fourth flow channel plate 44, a fifth flow channel plate 45, a sixth flow channel plate 46, a seventh flow channel plate 47, an eighth flow channel plate 48, a ninth flow channel plate 49, a tenth flow channel plate 50, a eleventh flow channel plate 51, a twelfth flow channel plate 52, a thirteenth flow channel plate 53, and a fourteenth flow channel plate 54. These plates are layered or stacked in the above order.

Each plate is formed with holes and ditches in various sizes. Inside the flow channel formation body where the respective plates are layered, the holes and the ditches are combined to form a plurality of nozzles 21, a plurality of individual flow channels 64, a supply manifold 22, and a return manifold 23 to act as liquid flow channels.

The nozzles 21 are formed to penetrate through the nozzle plate 40 in a layered direction (the vertical direction or the first direction). On the discharge surface 40*a* of the nozzle plate 40, the plurality of nozzle holes 21*a*, which are the leading ends of the nozzles 21, are provided to align in a predetermined direction orthogonal to the layered direction (to be referred to below as extension direction or second direction) to form a plurality of nozzle rows (arrays). The plurality of nozzle rows are arranged in the width direction (the third direction) orthogonal to the extension direction and the layered direction. In this embodiment, the extension direction and the width direction are parallel to the discharge surface (nozzle surface) 40*a*, while the layered direction is orthogonal to the discharge surface (nozzle surface) 40*a*.

The supply manifold 22 extends in the extension direction and is connected to the plurality of individual flow channels 64. The return manifold 23 also extends in the extension direction and is connected to the plurality of individual flow channels 64. The supply manifold 22 is arranged on the return manifold 23.

Figure 3:
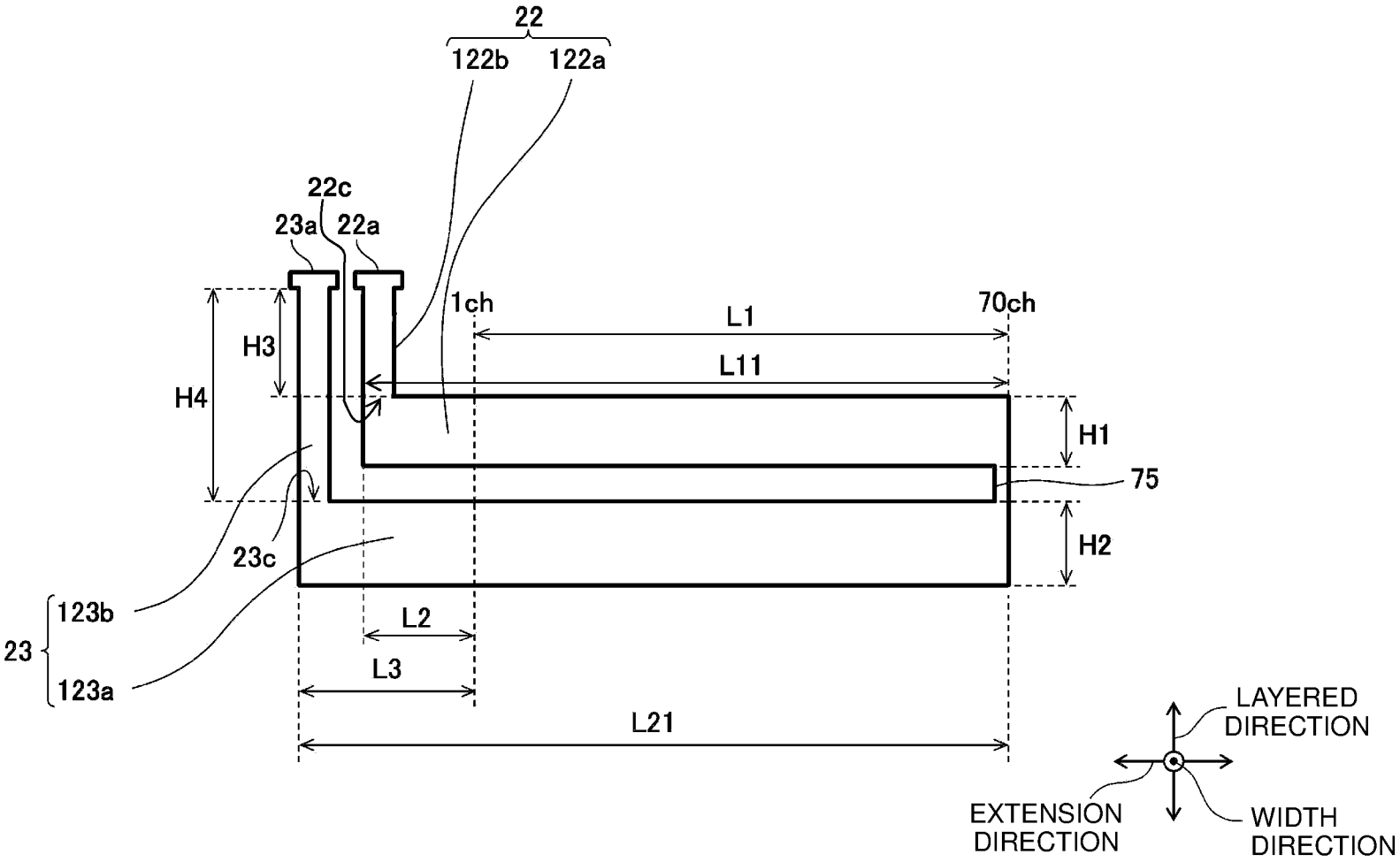
FIG. 3 is a side view showing a schematic shape of a supply manifold and a return manifold as viewed from a width direction.

Next, an explanation will be made on a schematic shape of the supply manifold 22 and the return manifold 23. FIG. 3 is a side view showing the schematic shape of the supply manifold 22 and the return manifold 23 as viewed from the width direction, for this embodiment. Note that the supply manifold 22 and the return manifold 23 are hollowed liquid flow channels, and FIG. 3 shows those hollows with their outlines.

As shown in FIG. 3, in this embodiment, the supply manifold 22 and the return manifold 23 are both formed into an L-shape. The supply manifold 22 includes a main part 122*a* (the first main part) extending in the extension direction and an upstand part 122*b* (the first upstand part) upstanding in the layered direction at one end of the main part 122*a* at one side in the extension direction (the left side in FIG. 3). That is, the upstand part 122*b* extends from the end of the main part 122*a* at the one side in the extension direction, to come away from the discharge surface 40*a* (the nozzle surface) along the vertical direction. Further, the return manifold 23 includes a main part 123*a* (the second main part) extending in the extension direction and an upstand part 123*b* upstanding in the layered direction at one end of the main part 123*a* at one side in the extension direction. That is, the upstand part 123*b* extends from the end of the main part 123*a* at the one side in the extension direction, to come away from the discharge surface 40*a* (the nozzle surface) along the vertical direction. Further, the supply manifold 22 and the return manifold 23 are connected through a bypass flow channel 75. In detail, the other end of the main part 122*a* of the supply manifold 22 (the right side in FIG. 3) at the other side in the extension direction (the end opposite to the upstand part 122*b*) is connected with the other end of the main part 123*a* of the return manifold 23 (the end opposite to the upstand part 123*b*) in the extension direction through the bypass flow channel 75.

The main part 122*a* of the supply manifold 22 is arranged above the main part 123*a* of the return manifold 23. In detail, the main part 123*a* of the return manifold 23 is arranged below the main part 122*a* of the supply manifold 22, and arranged to overlap in planar view with the main part 122*a* of the supply manifold 22. The upstand part 123*b* of the return manifold 23 is arranged outside of the upstand part 122*b* of the supply manifold 22 in the extension direction in planar view, at one end of the main part 123*a* at one side in the extension direction. Further, the upstand part 122*b* of the supply manifold 22 is arranged inside of the upstand part 123*b* of the return manifold 23 in the extension direction. In such configuration, one end of the return manifold 23 (the upstand part 123*b*) is positioned at the outer side in the extension direction than the one end of the supply manifold 22 (the upstand part 122*b*) where an aftermentioned supply port 22*a* is provided. In other words, in the extension direction, the end of the return manifold 23 (the upstand part 123*b*) at the one side in the extension direction (the left side in FIG. 3) is positioned between the end of the supply manifold 22 (the supply port 22*a*) at the one side in the extension direction (the left side in FIG. 3), and the end of the liquid discharge head 20 at the one side (not shown) in the extension direction (the left side in FIG. 3).

In this embodiment, in the layered direction, the first main part 122*a*, the second main part 123*a*, and the discharge surface 40*a* (the nozzle surface) are aligned in same order as written hereinabove. In the extension direction, the first upstand part 122*b*, the second upstand part 123*b*, and the end of the liquid discharge head 20 (not shown) at the one side in the extension direction (the left side in FIG. 3) are aligned in same order as written hereinabove.

In this embodiment, the main part 122*a* of the supply manifold 22 is as wide (in length according to the width direction) as the upstand part 122*b*, such as 1 to 2 mm, for example. A thickness H1 of the main part 122*a* of the supply manifold 22 (in length according to the layered direction) is 0.25 to 0.3 mm, for example. A height H3 of the upstand part 122*b* of the supply manifold 22 (the length in the layered direction) is 0.1 to 0.2 mm, for example. Further, the length L11 of the main part 122*a* of the supply manifold 22 (the length in the extension direction) is 42 to 43 mm, for example. In this context, each of the liquid discharge heads 20 is provided with 70 channels (ch), that is, 70 nozzles for example. The distance between the nozzles in the extension direction is 0.5 to 0.6 mm, for example. Then, the channel length L1, which is the length from the 1st ch to the 70th ch in the extension direction is 30 mm to 40 mm, for example. Further, the length L2 from the outer surface (the end at one side in the extension direction) of the upstand part 122*b* of the supply manifold 22 to the 1st channel in the extension direction is 6 to 8 mm, for example. Further, the maximum diameter (or aperture) of the upstand part 122*b* is 1 to 2 mm, for example.

On the other hand, the main part 123*a* of the return manifold 23 is as wide (in length according to the width direction) as the upstand part 123*b*, being 1 to 2 mm for example. A thickness H2 of the main part 123*a* of the return manifold 23 (in length according to the layered direction) is 0.35 to 0.45 mm, for example. In this manner, the thickness H2 of the main part 123*a* of the return manifold 23 is larger than the thickness H1 of the main part 122*a* of the supply manifold 22 (H2>H1). Further, a height H4 of the upstand part 123*b* of the return manifold 23 (in length according to the layered direction) is 0.5 to 0.6 mm, for example. Further, a length L21 of the main part 123*a* of the return manifold 23 (in length according to the extension direction) is 45 to 46 mm, for example. In this manner, the length L21 of the main part 123*a*, that is, the extension length of the return manifold 23, is larger than the length L11 of the main part 122*a*, that is, the extension length of the supply manifold 22 (L21>L11). Further, the length L3 from the outer surface (the end at one side in the extension direction) of the upstand part 123*b* of the supply manifold 23 to the 1st channel in the extension direction is 9 to 11 mm, for example. Further, the maximum diameter (or aperture) of the upstand part 123*b* is 1 to 2 mm, for example.

In this context, according to this embodiment, the return manifold 23 has a larger compliance than the supply manifold 22. Hereinbelow, the compliance of the return manifold 23 refers to the compliance of the main part 123*a* of the return manifold 23, whereas the compliance of the supply manifold 22 refers to the compliance of the main part 122*a* of the supply manifold 22. It is possible to find the compliance of each manifold according to the following formula.

$$Cp=V/(c^2\times\rho)$$

In the above calculation formula,

Cp is the compliance of each manifold;

V is the volume of each manifold;

c is the sound speed of ink inside each manifold; and

ρ is the ink density.

In this embodiment, the main part 123*a* of the return manifold 23 has a larger volume than the main part 122*a* of the supply manifold 22. The volume of the main part 123*a* of the return manifold 23 is 25 to 29 $mm^3$, for example, while the volume of the main part 122*a* of the supply manifold 22 is 19 to 24 $mm^3$, for example. The ratio of the volume of main part 123*a* of the return manifold 23 to the volume of the main part 122*a* of the supply manifold 22 is, for example, from 1.1 to 1.5. The ink density is, for example, 1,054 $kg/m^3$. Further, the ink sound speed inside each manifold is, for example, 91 m/s. Note that this ink sound speed is derived in consideration of the function of each damper part. That is, the ink sound speed is used in reality to calculate the compliance of each manifold including the influence exerted by each damper part on the manifold. Therefore, by appropriately designing the structure of each damper part, it is possible to suitably adjust the sound speed of ink inside each manifold. In this embodiment, the compliance of the supply manifold 22 is, for example, (1.8 to 2.4)$\times10^{-15}$ $m^3/Pa$, whereas the compliance of the return manifold 23 is, for example, (2.5 to 2.9)$\times10^{-15}$ $m^3/Pa$. Further, the ratio of the compliance of the return manifold 23 to the compliance of the supply manifold 22 is less than 2.0. In particular, the ratio of the compliance of the return manifold 23 to the compliance of the supply manifold 22 is, for example, from 1.1 to 1.5.

The main part 122*a* of the supply manifold 22 is formed by way of superimposing in the layered direction a through hole penetrating through the ninth flow channel plate 49 to the eleventh flow channel plate 51, and a recess recessing from the lower surface of the twelfth flow channel plate 52. Therefore, the lower end of the main part 122*a* of the supply manifold 22 is covered by the eighth flow channel plate 48 whereas the upper end is covered by an upper part of the twelfth flow channel plate 52.

The main part 123*a* of the return manifold 23 is formed by way of superimposing in the layered direction a through hole penetrating through the second flow channel plate 42 to the sixth flow channel plate 46, and a recess recessing from the lower surface of the seventh flow channel plate 47. Therefore, the lower end of the main part 123*a* of the return manifold 23 is covered by the first flow channel plate 41 whereas the upper end is covered by an upper part of the seventh flow channel plate 47.

Between such main part 122*a* of the supply manifold 22 and main part 123*a* of the return manifold 23, an air layer 24, which is a buffer space, is imposed. The air layer 24 is formed of a recess recessing from the lower surface of the eighth flow channel plate 48. In this manner, by interposing the air layer 24 between the main part 122*a* of the supply manifold 22 and the main part 123*a* of the return manifold 23, it is possible to reduce the interaction between the pressure of the liquid in the main part 122*a* of the supply manifold 22 and the pressure of the liquid in the main part 123*a* of the return manifold 23. Further, with the air layer 24 formed, the upper part of the eighth flow channel plate 48 functions as a supply damper part 70, while the upper part of the seventh flow channel plate 47 functions as a return damper part 71. In this case, the return damper part 71 is arranged above the main part 123*a* of the return manifold 23.

Inside the flow channel body (40 to 54), the buffer space 24 (the air layer) is formed between the supply manifold 22 and the return manifold 23 in the vertical direction. The return damper part 71 is a wall separating the return manifold 23 from the buffer space 24 (the air layer). The supply damper part 70 is a wall separating the supply manifold 22 from the buffer space 24 (the air layer).

In this embodiment, the supply damper part 70 may have the same compliance as the return damper part 71. This means that the degree of influence on the compliance of the supply manifold 22 due to the provision of the supply damper part 70 (the degree of pressure variation attenuating function) is equal to the degree of influence on the compliance of the return manifold 23 due to the provision of the return damper part 71.

Figure 4:
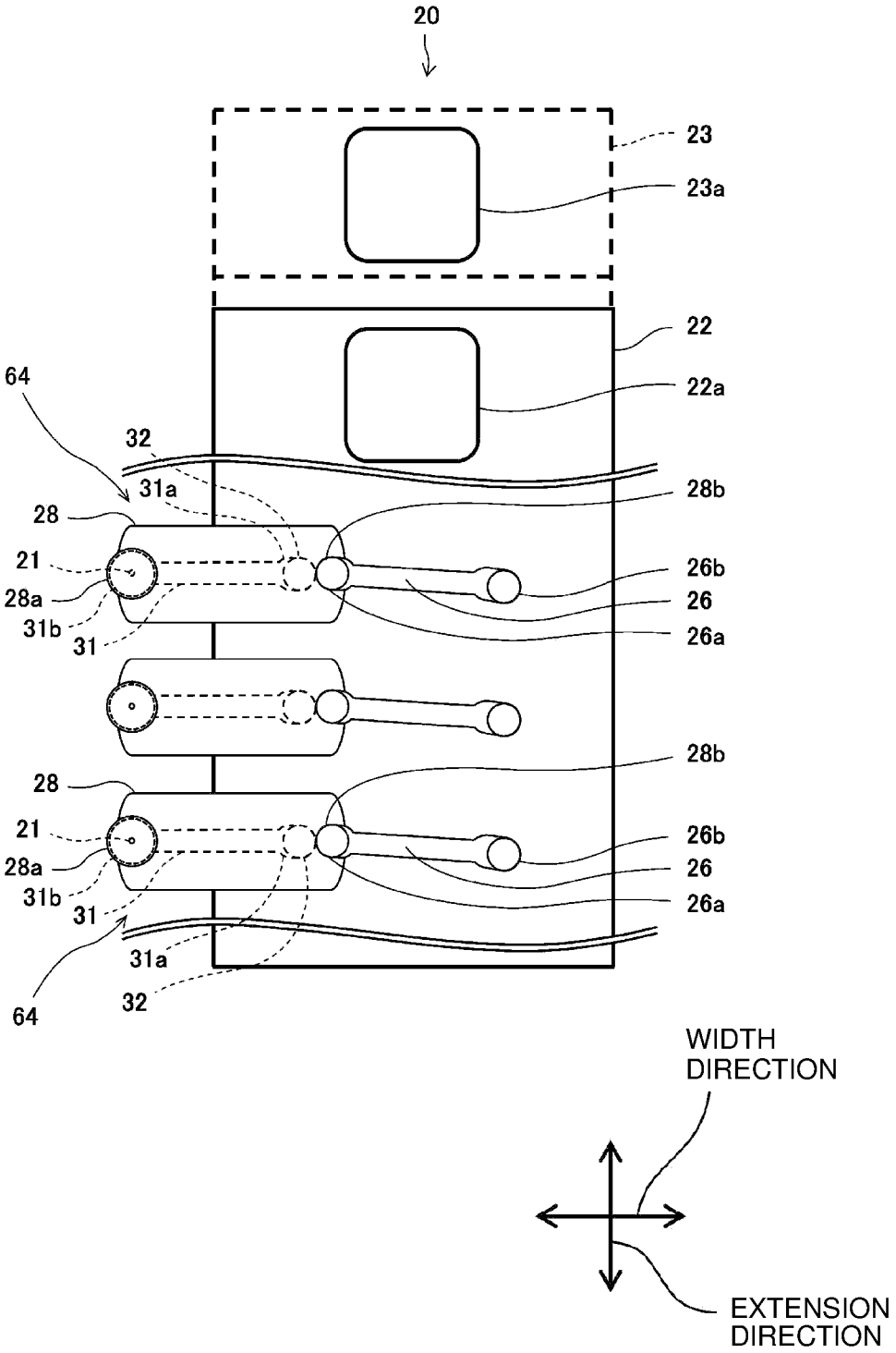
FIG. 4 is a plan view showing the supply manifold, the return manifold, and individual flow channels.

As shown in FIG. 4, for example a cylindrical supply port 22*a* is provided in an upper part of the upstand part 122*b* of the supply manifold 22. To an inner space of the supply port 22*a*, the upper end of the upstand part 122*b* as a supply channel is connected. The upstand part 122*b* extends downward from the supply port 22*a*. For example, the upstand part 122*b* is formed by penetrating through an upper part of the twelfth flow channel plate 52, the thirteenth flow channel plate 53, the fourteenth flow channel plate 54, the vibration plate 55, and an isolation film 56, as shown in FIG. 2. The lower end of the upstand part 122*b* is connected to a supply opening 22*c* provided in the main part 122*a* of the supply manifold 22.

Further, as shown in FIG. 4, for example a cylindrical return port 23*a* is provided in an upper part of the upstand part 123*b* of the return manifold 23. To the return port 23*a*, the upper end of the upstand part 123*b* as a return channel is connected. The upstand part 123*b* extends downward from the return port 23*a*. For example, the upstand part 123*b* is formed by penetrating through an upper part of the seventh flow channel plate 47, an upper part of the eighth flow channel plate 48, the ninth flow channel plate 49, the tenth flow channel plate 50, the eleventh flow channel plate 51, an upper part of the twelfth flow channel plate 52, the thirteenth flow channel plate 53, the fourteenth flow channel plate 54, the vibration plate 55, and the isolation film 56, as shown in FIG. 2. The lower end of the upstand part 123*b* is connected to a return opening 23*c* provided in the main part 123*a* of the return manifold 23. The return opening 23*c* is arranged at the outer side than the supply port 22*a* in the extension direction.

Returning to FIG. 2, the plurality of individual flow channels 64 are connected to the supply manifold 22 and the return manifold 23. The individual flow channels 64 are each connected to the supply manifold 22 with the upper end (one end) and each connected to the return manifold 23 with the lower end (the other end) and, in between, each connected to the base end of a nozzle 21. Each of the individual flow channels 64 has a first communication hole 25, a supply throttle channel 26, a second communication hole 27, a pressure chamber 28, a descender 29, a return throttle channel 31, and a third communication hole 32, those members being arranged in the same order as written above.

The first communication hole 25 is connected to the upper end of the supply manifold 22 with the lower end to extend upward from the supply manifold 22 in the layered direction, penetrating through an upper part of the twelfth flow channel plate 52 in the layered direction. The first communication hole 25 is arranged at one side (the right side in FIG. 2) with respect to the center of the supply manifold 22 in the width direction.

One end 26*b* of the supply throttle channel 26 is connected to the upper end of the first communication hole 25 (FIG. 4). The supply throttle channel 26 is formed by way of half-etching, for example, and constructed of a ditch recessing from the lower surface of the thirteenth flow channel plate 53. Further, the second communication hole 27 is connected to the other end 26*a* of the supply throttle channel 26 with the lower end (FIG. 4) to extend upward from the supply throttle channel 26 in the layered direction, penetrating through an upper part of the thirteenth flow channel plate 53 in the layered direction. The second communication hole 27 is arranged at the other side in the width direction (the left side in FIG. 2) with respect to the center of the supply manifold 22 in the width direction.

Each of the pressure chambers 28 is connected to the upper end of the second communication hole 27 with one end 28*b* (FIG. 4). The pressure chamber 28 is formed to penetrate through the fourteenth flow channel plate 54.

The descender 29 is arranged to penetrate through the first flow channel plate 41 to the thirteenth flow channel plate 53 in the layered direction at the other side than the supply manifold 22 and the return manifold 23 in the width direction (the right side in FIG. 2). The upper end of the descender 29 is connected to the other end 28*a* of the pressure chamber 28 (FIG. 4), and the lower end is connected to the nozzle 21. For example, the nozzle 21 is arranged to overlap in the layered direction with the descender 29 at the center of the descender 29 in a direction orthogonal to the layered direction. Note that the descender 29 may have a constant or variable area of cross section in the layered direction.

One end 31*b* of the return throttle channel 31 is connected to the lower end of the descender 29 (FIG. 4). The return throttle channel 31 is formed of a ditch recessing from the lower surface of the first flow channel plate 41 by way of etching process, for example.

The lower end of the third communication hole 32 is connected to the other end 31*a* of the return throttle channel 31 (FIG. 4) and the third communication hole 32 extends upward in the layered direction from the return throttle channel 31 to penetrate through an upper part of the first flow channel plate 41 in the layered direction. The upper end of the third communication hole 32 is connected to the lower end of the return manifold 23. The third communication hole 32 is arranged at the other side of the return manifold 23 in the width direction with respect to the center (the left side in FIG. 2).

The vibration plate 55 is stacked on the fourteenth flow channel plate 54 to cover the upper openings of the pressure chambers 28. Note that the vibration plate 55 may be formed integrally with the fourteenth flow channel plate 54. In such case, the pressure chambers 28 are formed by recessing from the lower surface of the fourteenth flow channel plate 54 in the layered direction. An upper part of the fourteenth flow channel plate 54 functions as the vibration plate 55 above the pressure chambers 28.

The piezoelectric element 60 includes a common electrode 61 and individual electrodes 63 which are arranged in the same order as written above. The common electrode 61 covers the entire surface of the vibration plate 55 via the isolation film 56. The piezoelectric layer 62 is provided for each pressure chamber 28 and arranged on the common electrode 61 to overlap with the pressure chamber 28. The individual electrode 63 is provided for each pressure chamber 28 and arranged on the piezoelectric layer 62. In this context, one piezoelectric element 60 is constructed from one individual electrode 63, the common electrode 61, and the piezoelectric layer 62 (the active part) interposed by the two electrodes.

The individual electrodes 63 are connected electrically to a driver IC. The driver IC receives a control signal from an unshown controller, to generate a drive signal (voltage signal) to be applied to the individual electrodes 63. On the other hand, the common electrode 61 is maintained at the ground potential constantly.

According to the drive signal, the active part of the piezoelectric layer 62 expands and contracts in the planar direction together with the two electrodes 61 and 63. According to that, the vibration plate 55 cooperates to deform to displace in a direction where the pressure chamber 28 changes in volume. By virtue of this, a discharge pressure is applied to the pressure chamber 28 according to the volume of the pressure chamber 28 to discharge the liquid from the pressure chamber 28.

Figure 5:
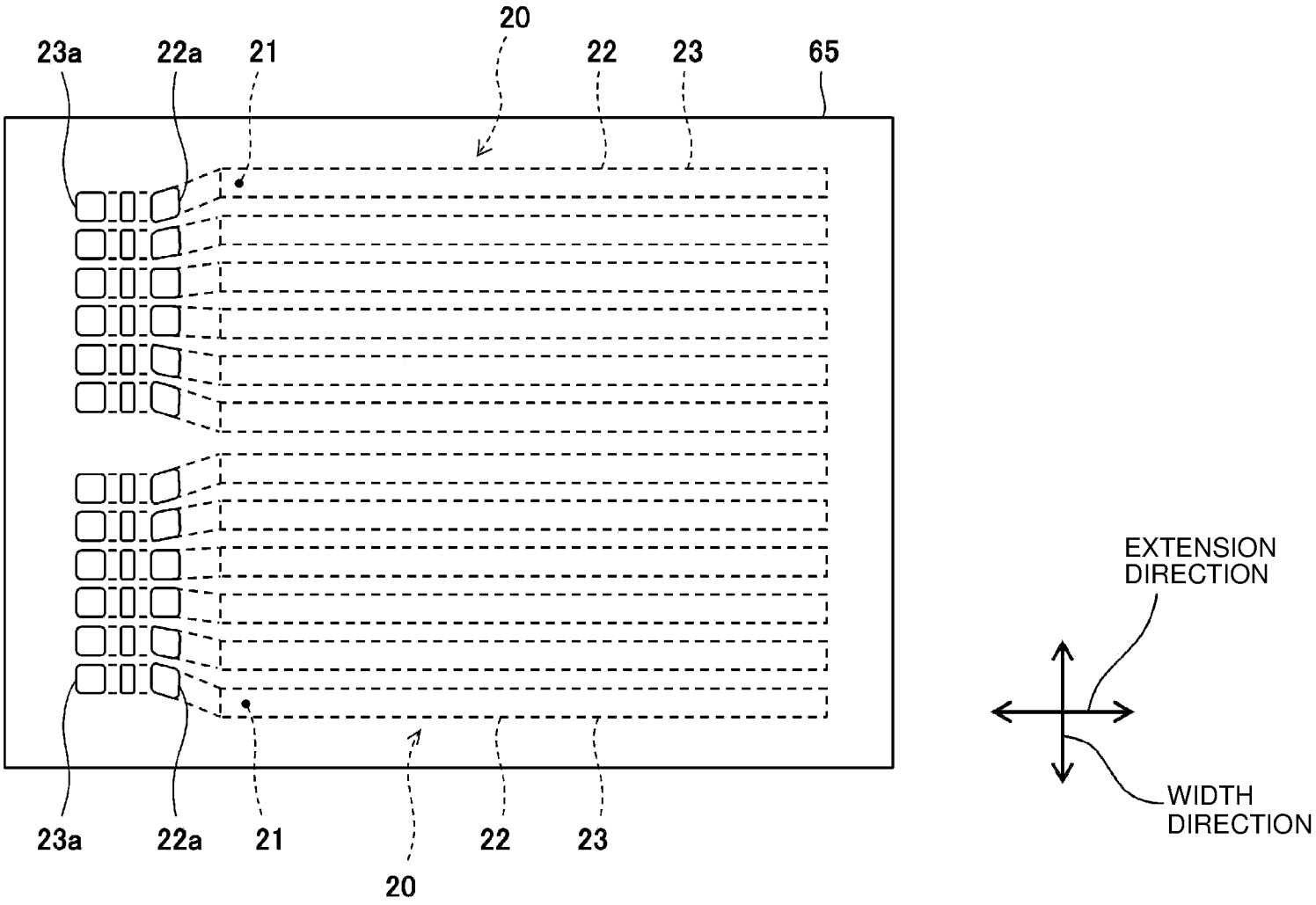
FIG. 5 is a plan view of a frame on which a plurality of liquid discharge heads are mounted.

Next, FIG. 5 presents a plan view of a frame 65 on which the plurality of liquid discharge heads 20 are mounted, according to this embodiment.

As shown in FIG. 5, the plurality of liquid discharge heads 20 are arranged respectively along the extension direction. As explained with FIG. 4, too, the supply port 22*a* and the return port 23*a* are provided at the one side in the extension direction (the left side in FIG. 5). The supply port 22*a* and the return port 23*a* are provided for each supply manifold 22 and each return manifold 23. As shown in FIG. 5, the plurality of supply manifolds 22 are arranged to align in the width direction. The two supply manifolds 22 positioned respectively at the two opposite ends in the width direction are defined as the two opposite-end supply manifolds 22. All supply ports 22*a* and return ports 23*a* are arranged between the two opposite-end supply manifolds 22 in the width direction. As shown in FIG. 5, too, the plurality of return manifolds 23 are arranged to align in the width direction. The two return manifolds 23 positioned respectively at the two opposite ends in the width direction are defined as the two opposite-end return manifolds 23. All supply ports 22*a* and return ports 23*a* are arranged between the two opposite-end return manifolds 23 in the width direction.

<Flow of the Liquid>

An explanation will be made on the flow of the liquid such as an ink or the like in the liquid discharge heads 20 of this embodiment. The supply ports 22*a* are connected to the tank 12 through a supply pipe while the return ports 23*a* are connected to the tank 12 through a return pipe. In such a configuration, if a pump for the supply pipe and a negative pressure pump for the return pipe are driven, then from the tank 12, the liquid passes through the supply pipe and flows into the supply manifolds 22 via the supply ports 22*a*.

During this period, part of the liquid flows into the individual flow channels 64. The liquid flows from the supply manifold 22 to the supply throttle channel 26 through the first communication hole 25, and flows on from the supply throttle channel 26 to the pressure chambers 28 via the second communication hole 27. Then, the liquid flows in the descender 29 from the upper end to the lower end in the layered direction and flows on into the nozzles 21. Then, if the piezoelectric element 60 applies the discharge pressure to the pressure chambers 28, then the liquid is discharged from the nozzle holes 21*a*.

Part of the liquid which was not discharged from the nozzle holes 21*a* flows through the return throttle channel 31 and flows on to the return manifold 23 via the third communication hole 32. Then, the liquid having flowed into the return manifold 23 via the third communication hole 32 flows on in the return manifold 23 and then is discharged (flown out) from the return port 23*a* to the outside, returning to the tank 12 through the return pipe. By virtue of this, the liquid which was not discharged from the nozzle holes 21*a* circulates between the tank 12 and the individual flow channels 64.

As explained above, according to the liquid discharge head 20 of this embodiment, the compliance of the return manifold 23 is larger than the compliance of the supply manifold 22. The compliance can be regarded as a measure of the structure's overall elasticity or plasticity. The higher the compliance thereof, the easier it is for the structure to move due to the applied force to the structure. Hence, if the return manifold 23 has a larger compliance, then it is possible to suppress much of the influence of crosstalk through the return manifold 23. Therefore, it is possible to suppress the instability of liquid discharge due to the influence of crosstalk through the return manifold 23, more effectively than conventional methods.

Further, in this embodiment, the main part 123*a* of the return manifold 23 has a larger volume than the main part 122*a* of the supply manifold 22. By virtue of this, it is possible to easily increase the compliance of the return manifold 23. For example, the compliance of the return manifold 23 can be increased by expanding the area of the return damper part 71. However, it is much easier to increase the compliance by increasing the volume of the main part 123*a* of the return manifold 23 than by expanding the area of the return damper part 71. This is because on one hand, it is difficult to control the depth of the half etching for forming the return damper part 71 in the half-etching process and, on the other hand, it is easier to change the design of the full etching for forming the return manifold 23 than the half etching.

Further, in this embodiment, the thickness H2 of the main part 123*a* of the return manifold 23 is larger than the thickness H1 of the main part 122*a* of the supply manifold 22. In this case, it is possible to increase the volume of the liquid discharge head 20 without expanding its planar area. By virtue of this, it is possible to make the liquid discharge head 20 into a compacted size in the planar direction.

Further, in this embodiment, the ratio of the compliance of the return manifold 23 to the compliance of the supply manifold 22 is less than 2.0 (1.1 for example). In this case, it is possible to suppress the influence of crosstalk while avoiding an upsized head.

Further, in this embodiment, the compliance of the supply damper part 70 is the same as that of the return damper part 71. That is, it is possible to equalize the degree of the influence (the degree of pressure variation attenuating function) on the compliance of the supply manifold 22 due to the provision of the supply damper part 70, and the degree of the influence on the compliance of the return manifold 23 due to the provision of the return damper part 71. Further, it is also possible to design each damper part with the same process.

Further, in this embodiment, the return damper part 71 is arranged above the main part 123*a* of the return manifold 23. In this aspect, because the return throttle channel 31 is below the main part 123*a* of the return manifold 23, if the return damper part 71 is provided below the main part 123*a* of the return manifold 23, then the return damper part 71 will be downsized. Therefore, by arranging the return damper part 71 above the main part 123*a* of the return manifold 23, it is possible to raise the damper performance while securing the length of the throttle (that is, the return throttle channel 31) near the nozzles 21.

Further, in this embodiment, the main part 122*a* of the supply manifold 22 is connected with the main part 123*a* of the return manifold 23 through the bypass flow channel 75. In this case, it is possible to increase the flow amount of the liquid flowing in the supply manifold 22 and the return manifold 23 by providing the bypass flow channel 75 such that it is possible to improve the performance of air discharge.

Further, in this embodiment, the main part 123*a* of the return manifold 23 is longer than the main part 122*a* of the supply manifold 22 in the extension direction. Thus, when the two-layer structure (two-story structure) is realized in the arrangement of the main part 122*a* of the supply manifold 22 above the main part 123*a* of the return manifold 23, it is possible to arrange the supply port 22*a* and the return port 23*a* without interference of each manifold in the extension direction.

Further, in this embodiment, one end of the return manifold 23 (the upstand part 123*b*) at one side in the extension direction is positioned at the outer side in the extension direction than the one end of the supply manifold 22 (the upstand part 122*b*) where the supply port 22*a* is provided. By virtue of this, it is possible to increase the volume of each manifold based on realizing the two-layer structure where the main part 122*a* of the supply manifold 22 is arranged above the main part 123*a* of the return manifold 23.

MODIFIED EMBODIMENTS

The present disclosure is not limited to the above embodiment and can undergo various changes and modifications without departing from the true spirit and scope of the present disclosure. For example, some modified embodiments are conceived as follows.

In the above embodiment, in the two-layer structure, the main part 122*a* of the supply manifold 22 is arranged above the main part 123*a* of the return manifold 23. That is, the main part 123*a* of the return manifold 23 is arranged as the first layer of the two-layer structure, whereas the main part 122*a* of the supply manifold 22 is arranged as the second layer. However, without being limited to that, the main part 122*a* of the supply manifold 22 may be arranged as the first layer of the two-layer structure, whereas the main part 123*a* of the return manifold 23 be arranged as the second layer.

Further, in the above embodiment, the main part 122*a* of the supply manifold 22 and the main part 123*a* of the return manifold 23 extend respectively in the extension direction. However, without being limited to that, the main part 122*a* of the supply manifold 22 and the main part 123*a* of the return manifold 23 may extend respectively in the width direction.

Further, in the above embodiment, the supply damper part 70 is arranged below the main part 122*a* of the supply manifold 22 whereas the return damper part 71 is arranged above the main part 123*a* of the return manifold 23. However, without being limited to that, each damper part may be arranged beside a manifold in the extension direction. That is, each damper part may be provided at an end of each manifold.

Further, in the above embodiment, the supply manifold 22 is formed into an L-shape. However, without being limited to that, the supply manifold 22 may be constructed of the main part 122*a* alone. Further, the return manifold 23 is also formed into an L-shape. However, without being limited to that, the return manifold 23 may be constructed of the main part 123*a* alone.

What is claimed is:

1. A liquid discharge head comprising:

a plurality of nozzles aligned on a nozzle surface;

a supply manifold arranged apart from the nozzle surface in a first direction orthogonal to the nozzle surface, and configured that a liquid is supplied therein from the outside of the liquid discharge head;

a return manifold which is arranged between the nozzle surface and the supply manifold in the first direction, which is configured that the liquid is flown out therefrom to the outside of the liquid discharge head, and which is provided with a return damper part; and a plurality of individual flow channels each of which corresponds to one of the plurality of nozzles, and each of which has one end connected to the supply manifold and the other end connected to the return manifold, wherein each of the plurality of individual flow channels has a return throttle channel communicating the corresponding nozzle with the return manifold and being arranged between the return manifold and the nozzle surface in the first direction, and the return manifold has a compliance larger than a compliance of the supply manifold.

2. The liquid discharge head according to claim 1, wherein the return manifold has a volume larger than the compliance of the supply manifold.

3. The liquid discharge head according to claim 1, wherein the return manifold has a length in the first direction larger than the compliance of the supply manifold.

4. The liquid discharge head according to claim 1, wherein the ratio of the compliance of the return manifold to the compliance of the supply manifold is less than 2.0.

5. The liquid discharge head according to claim 4, wherein the ratio of the compliance of the return manifold to the compliance of the supply manifold ranges from 1.1 to 1.5.

6. The liquid discharge head according to claim 1, wherein the supply manifold is provided with a supply damper part, and a compliance of the supply damper part is equal to a compliance of the return damper part.

7. The liquid discharge head according to claim 1, wherein the return damper part is arranged between the return manifold and the supply manifold in the first direction.

8. The liquid discharge head according to claim 1, further comprising a bypass flow channel connecting the supply manifold and the return manifold.

9. The liquid discharge head according to claim 1, wherein the supply manifold and the return manifold extend in a second direction orthogonal to the first direction, and the return manifold is longer than the supply manifold in the second direction.

10. The liquid discharge head according to claim 1, wherein the supply manifold is provided with a supply port at an end of the supply manifold on one side in a second direction orthogonal to the first direction, the supply port being configured that the liquid is supplied via the supply port from the outside of the liquid discharge head and, in the second direction, an end of the return manifold on the one side in the second direction is positioned between the supply port and an end of the liquid discharge head on the one side in the second direction.

11. The liquid discharge head according to claim 1, wherein the supply manifold has:

a first main part extending in a second direction orthogonal to the first direction, and a first upstand part extending from an end of the first main part on one side in the second direction, to come away from the nozzle surface along the first direction;

the return manifold has:

a second main part extending in the second direction, and a second upstand part extending from an end of the second main part on the one side in the second direction, to come away from the nozzle surface along the first direction;

the first main part, the second main part, and the nozzle surface are arranged in this order in the first direction; and the first upstand part, the second upstand part, and an end of the liquid discharge head on the one side in the second direction are arranged in this order in the second direction.

12. The liquid discharge head according to claim 1, comprising a flow channel formation body which is a stacked body of a plurality of plates, wherein the flow channel formation body is formed therein with the nozzles, the supply manifold, the return manifold, and the plurality of individual flow channels;

a buffer space is formed, in the flow channel formation body, between the supply manifold and the return manifold in the first direction; and the return damper part is a wall separating the return manifold from the buffer space.

13. The liquid discharge head according to claim 12, wherein the supply manifold is provided with a supply damper part, and the supply damper part is a wall separating the supply manifold from the buffer space.

14. The liquid discharge head according to claim 13, wherein the supply damper part has the same compliance as the return damper part.

* * * * *